US007698864B2

(12) United States Patent
Justice et al.

(10) Patent No.: US 7,698,864 B2
(45) Date of Patent: Apr. 20, 2010

(54) BONDED SIDING PANELS

(75) Inventors: Brett C Justice, Warren, OH (US); Jeffrey H Landon, Granger, IN (US)

(73) Assignee: Atlantis Plastics, Inc., Elkhart, IN (US)

( * ) Notice: Subject to any disclaimer, the term of this patent is extended or adjusted under 35 U.S.C. 154(b) by 1210 days.

(21) Appl. No.: 11/181,448

(22) Filed: Jul. 14, 2005

(65) Prior Publication Data

US 2007/0011966 A1 Jan. 18, 2007

(51) Int. Cl.

| | |
|---|---|
| ***E04D 1/00*** | (2006.01) |
| ***E04D 1/08*** | (2006.01) |
| ***E04D 1/22*** | (2006.01) |
| ***E04D 3/362*** | (2006.01) |

(52) U.S. Cl. ..... 52/519; 52/529; 52/531; 52/540; 52/546; 52/558

(58) Field of Classification Search ..... 52/309.1, 52/519–572

See application file for complete search history.

(56) References Cited

U.S. PATENT DOCUMENTS

| | | | | |
|---|---|---|---|---|
| 1,772,694 | A | 8/1930 | White | |
| 2,264,546 | A | 12/1941 | Ochs | |
| 3,265,420 | A | 8/1966 | Goodrich et al. | |
| 3,437,360 | A | 4/1969 | Gould | |
| 3,473,274 | A * | 10/1969 | Godes | 52/127.5 |
| 3,504,467 | A * | 4/1970 | Caulfield et al. | 52/309.1 |
| 3,593,479 | A | 7/1971 | Hinds | |
| 3,977,145 | A | 8/1976 | Dobby et al. | |
| 4,034,528 | A | 7/1977 | Sanders et al. | |
| 4,096,011 | A | 6/1978 | Sanders et al. | |
| 4,147,300 | A * | 4/1979 | Milburn, Jr. | 126/613 |
| 4,272,576 | A | 6/1981 | Britson | |
| 4,320,613 | A | 3/1982 | Kaufman | |
| 4,327,528 | A * | 5/1982 | Fritz | 52/309.1 |
| 4,343,126 | A * | 8/1982 | Hoofe, III | 52/313 |
| 4,432,181 | A | 2/1984 | Funaki | |
| 4,435,933 | A * | 3/1984 | Krowl | 52/309.1 |
| 4,736,565 | A | 4/1988 | Bisson | |
| 5,150,555 | A | 9/1992 | Wood | |
| 5,224,318 | A * | 7/1993 | Kemerer | 52/521 |
| 5,249,402 | A * | 10/1993 | Crick et al. | 52/533 |
| 5,347,784 | A * | 9/1994 | Crick et al. | 52/520 |
| 5,349,802 | A | 9/1994 | Kariniemi | |
| 5,461,839 | A | 10/1995 | Beck | |
| 5,465,486 | A * | 11/1995 | King | 29/897.32 |

(Continued)

*Primary Examiner*—Brian E Glessner
*Assistant Examiner*—Jason Holloway
(74) *Attorney, Agent, or Firm*—Baker & Daniels LLP

(57) ABSTRACT

A polymer siding panel for mounting on a wall surface that in one embodiment includes at least two horizontal adjacent sections and a plurality of decorative elements integrally formed with the said panel and disposed in at least one row. The panel may also include an upwardly facing channel formed on a rear side of the siding panel opposite the front face; and at least two splicing members. The splicing members may be transparent or translucent and manufactured from a polymer that is the same or different than the polymer of the siding panel, and one of the splicing members may be welded to and joining the sections to one another. The other splicing member can be welded to one of the sections at a side edge opposite the side edge adjoining the other section. The other splicing member may extend beyond the respective side edge.

34 Claims, 9 Drawing Sheets

U.S. PATENT DOCUMENTS 5,537,792 A * 7/1996 Moliere ..... 52/531
5,553,434 A 9/1996 Tamura
5,661,939 A 9/1997 Coulis et al.
5,675,955 A 10/1997 Champagne
5,729,946 A 3/1998 Beck
5,768,844 A 6/1998 Grace, Sr. et al.
5,794,396 A 8/1998 Gibbs
5,806,185 A * 9/1998 King ..... 29/897.32
5,946,876 A 9/1999 Grace, Sr. et al.
6,050,041 A 4/2000 Mowery et al.
6,122,877 A 9/2000 Hendrickson et al.
6,155,006 A 12/2000 Mimura et al.
6,301,856 B1 * 10/2001 Nasi ..... 52/712
D452,334 S 12/2001 Gilbert et al.
6,393,792 B1 5/2002 Mowery et al.
6,526,717 B2 3/2003 Waggoner et al.
6,625,939 B1 9/2003 Beck et al.
6,679,011 B2 1/2004 Beck et al.
6,682,814 B2 * 1/2004 Hendrickson et al. ..... 428/326
6,715,240 B2 4/2004 Beck et al.
6,715,250 B2 * 4/2004 Bryant et al. ..... 52/528
6,955,019 B2 * 10/2005 Donlin et al. ..... 52/520
6,976,342 B1 * 12/2005 Kowalevich ..... 52/546
7,207,145 B2 * 4/2007 Stucky et al. ..... 52/555
7,240,461 B1 * 7/2007 Vandeman et al. ..... 52/539
2001/0049918 A1 12/2001 Gilbert et al.
2002/0092256 A1 7/2002 Hendrickson et al.
2003/0097810 A1 * 5/2003 Leichtfried ..... 52/518
2004/0056006 A1 * 3/2004 Jones et al. ..... 219/121.64
2005/0072093 A1 * 4/2005 King ..... 52/522
2005/0193674 A1 * 9/2005 Hatkoff ..... 52/561

* cited by examiner

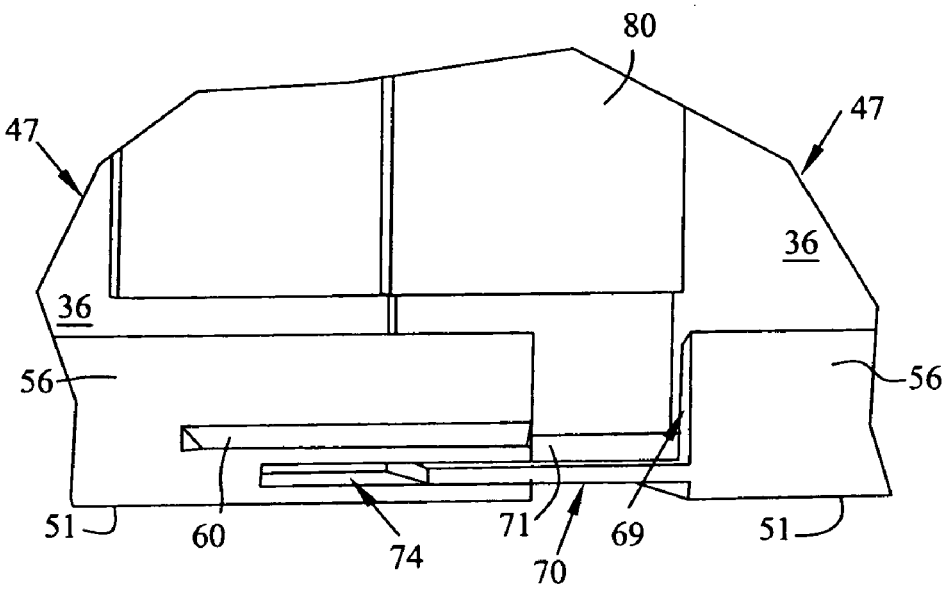
FIG. 11
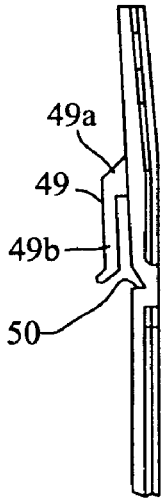
FIG. 12
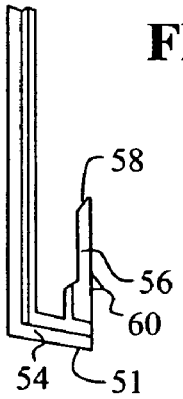

BONDED SIDING PANELS

BACKGROUND OF THE INVENTION

The present invention relates to decorative exterior wall coverings, and in particular, to bonded injection molded siding panels having attachment elements to facilitate easier installation and functional elements to improve the aesthetics and performance of the panels.

Many types of exterior wall panels are currently known and used in the construction and improvement of residential, commercial, and industrial and other buildings. Typically, such panels are formed from a lightweight composite plastic material and are manufactured using conventional extrusion molding, injection molding, impression molding, vacuum molding or thermal molding processes. Such panels may be formed in various shapes, such as individual elongated sections similar to standard aluminum siding or single panels incorporating one or more rows of individual decorative elements. Individual panels are often connected to other previously installed, identical panels through a vertical attachment and a horizontal attachment by which portions of the panel to be installed overlap portions of previously installed panels.

Some prior known panel designs employ vertical side and horizontal bottom connections that must be viewed and fitted simultaneously by the installer during installation. The problem with these designs is that the installation of such panels is difficult because the installer can only do one connection at a time. Often the installer would attempt to circumvent this problem by first connecting only the vertical side of the horizontal bottom, only to discover that the remaining connection either cannot be attached, or will cause the initial connection to slip out of place.

In addition, many prior known panel designs have both side and bottom connections that require precise fit. Installation of these panels with such precise connections is difficult for several reasons. For example, often an entire row of connection must be attached along the vertical side or horizontal bottom of a panel, necessitating frequent checking and adjusting as the panel is maneuvered into its installed position. Also, this problem is exacerbated by the need for such panels to overlap in order to conceal their attachment points because connections are hidden from the installer as they are attached during installation. The installer is often forced to either position his head in an awkward viewing position near the wall surface when fitting the panel into position.

Further, prior panels have employed fastener attachments located on the rear of the panels that have no relations to reference elements on the front side of the panel. For example, one prior design comprises a series of tabs at intervals on the rear side of the panels that do not correspond to arrangements of any elements or reference points on the front side. This problem hampers installation because as described above, these elements are hidden from the installer during installation and the installer cannot, by simply looking at the front of the panel, identify the locations of the attachment elements on the rear side of the panel.

Prior known panel designs have also employed connections that lock firmly into place upon attachment. The problem with such a connection is that it may be so rigid that it cannot accommodate the inevitable movement associated with thermal expansion or contraction or the settling of the underlying wall surface after the panels are installed. This may cause buckling of the paneling or tearing of the attachments.

Also, many prior panel designs have been difficult to cut, trim, or otherwise adjust to fit into tight areas along the wall surface, such as within the gable of the roofline or the area surrounding windows or other surface irregularities. Some existing panels may only be cut in certain structurally designated locations without comprising their overall structural integrity. Other panels are made of materials that are difficult to cut occasionally requiring certain types of saws and saw blades.

In addition, many installers prefer panels that are well over the 8-foot length such as is common with aluminum siding or extruded vinyl siding. However, the extrusion process is not capable of providing a decorative appearance on the face of a siding panel that has the detail that can be obtained by using a process such as the injection molding process. For example, the extrusion process is not suitable for forming a panel having simulated cedar shake elements. The best process for forming elements of this type is the injection molding process; however, due to the cost of providing dies and extrusion machines of sufficient size, it is not common to use the injection molding process to produce panels that are 8 feet or longer. The vacuum thermal process has also been used to provide a simulated shake element on polymer panels in longer lengths; however, the aesthetic appearance and detail of panels formed with this process is considerably lacking compared to panels formed by the injection molding process.

It is therefore an object of the present invention to provide a wall panel that is easy to install. It is a further object that the invention that the panel have sound connections, but will readily allow for expansion and contraction of panels without comprising the integrity of the connections or adversely affecting the panels. It is also an object of the invention that the panels may be readily installed by a single installer. Another object of the invention is to provide a siding panel that may be formed by the injection molding process to obtain the superior aesthetics of simulated building elements such as cedar shake and that can be produced in lengths of 8 feet or longer.

One method of joining panels of a shorter lengths to form panels of a longer length by using a splicing member is disclosed in U.S. Pat. Nos. 6,050,041 and 6,393,792 B1, both to Mowery et al, and both of which are incorporated in their entirety herein by reference. Mowery, et al, discloses a splicing member having a formed flange that is received in a protruding flange of the panel. The splicing member may be attached to the panels using a fastener such as a rivet or screw, by use of an adhesive, or by welding the splicing member to the panels. It would be desirable, however, to provide a simple splicing member that can be used to join two sections of panel members together and that does not require locking flanges.

As such, an additional object of the invention is to provide a panel that has two or more sections joined together using a splicing member that does not require a flange or other interlocking configuration that fits into the flange portion of the panels therein.

A further object of the invention is to provide a method for cutting panels that are fused together to minimize waste. These and other objects of the invention have been accomplished by the decorative wall panels as set forth and described below.

SUMMARY OF THE INVENTION

It is a feature of the invention to provide a polymer siding panel for mounting on a wall surface that in one embodiment includes at least two horizontal adjacent sections; a plurality of decorative elements integrally formed with the panel and disposed in at least one row, the decorative elements defining a front face of the siding panel; a top edge disposed above the decorative elements; a plurality of apertures formed in and extending through the siding panel disposed below the top edge and above the decorative elements; a plurality of downwardly depending tabs located on the front face of the siding panel; an upwardly facing channel formed on a rear side of the siding panel opposite the front face; and at least two splicing members.

The splicing members may be transparent or translucent and manufactured from a polymer that is different than the polymer of the siding panel, and one of the splicing members may be welded to and joining the sections to one another.

The other splicing member can be welded to one of the sections at a side edge opposite the side edge adjoining the other section. The other splicing member may extend beyond the respective side edge. The upwardly facing channel may have a vertical leg and a bottom leg, and one of the side edges of the panel can include a notch in the vertical leg. The polymer siding panel may further include an upwardly extending lip on the bottom leg adjacent the notch. The bottom leg may have a portion adjacent the notch that is stepped to be higher than the rest of the bottom leg. The upwardly extending lip can be positioned intermediate the rear face and an outer end of the bottom leg. The side edge opposite the side edge having the notch may include a horizontal slot in the vertical leg. The slot can be configured to receive the stepped portion of the bottom leg of an adjacent panel with the upwardly extending lip on the adjacent panel fitting behind the vertical leg above the horizontal slot.

The polymer siding panel may also include scrap reducing cutting planes for trimming or cutting the length of the panel to reduce waste. The vertical leg of the upwardly extending channel may include a horizontal slot coinciding with each of the cutting planes.

The upwardly facing channel may include a vertical leg having a projection extending back therefrom away from the rear face. The front face of the panel may include a groove above the decorative elements configured to receive the projection of a vertically adjacent panel. The groove can lock with the projection of the vertically adjacent panel to prevent relative vertical movement between the panels while allowing the panels to slide horizontally relative to one another.

It is also a feature of the invention to provide an embodiment of a polymer siding panel for mounting on a wall surface that includes a plurality of decorative elements integrally formed with the panel and disposed in at least one row, the decorative elements defining a front face of the siding panel; a top edge disposed above the decorative elements; a plurality of apertures formed in and extending through the siding panel disposed below the top edge and above the decorative elements; a bottom end; a plurality of downwardly depending tabs located on the front face of the siding panel; an upwardly facing channel formed on a rear side of the siding panel along the bottom end, the channel having a vertical leg and a bottom leg and the channel configured for receipt of the tabs of a vertically adjacent panel; and a pair of side edges, one of the side edges including a notch in the vertical leg of the upwardly facing channel and an upwardly extending lip on the bottom leg adjacent the notch. The bottom leg may have a stepped portion adjacent the notch that is vertically offset from this remainder of the bottom leg.

The upwardly extending lip can be located intermediate the rear face and an outer end of the bottom leg. The side edge opposite the side edge with the notch may include a horizontal slot in the vertical leg. The horizontal slot may be configured to receive the stepped portion of the bottom leg on an adjacent panel with the upwardly extending lip located behind the vertical leg above the horizontal slot.

The polymer siding panel may further include at least two horizontal adjacent sections and at least two splicing members. The splicing members can be manufactured from a polymer, and one of the splicing members can be welded to and join the sections to one another along side edges thereof. The other splicing member can be welded to one of the sections at a side edge opposite the side edge joined to the other section, with the other splicing member extending beyond the respective side edge.

The polymer siding panel may further include scrap reducing cutting planes to trim or cut the panel to reduce waste. The vertical leg of the upwardly facing channel may include a horizontal slot coinciding with each of the cutting planes.

The polymer siding panel may further include a projection extending back from the vertical leg of said upwardly facing channel away from the rear face and a groove above the elements configured to receive the projection of a vertically adjacent panel. The groove may lock with the projection of the vertically adjacent panel to prevent relative vertical movement between the panels while allowing the panels to slide horizontally relative to one another.

It is another feature of the invention to provide an embodiment of a polymer siding panel for mounting on a wall surface that includes a plurality of decorative elements integrally formed with the panel and disposed in at least one row, the decorative elements defining a front face of the siding panel; a top edge disposed above the decorative elements; a plurality of apertures formed in and extending through the siding panel disposed below the top edge and above the decorative elements; a bottom end; a plurality of downwardly depending tabs located on the front face of the siding panel; an upwardly facing channel formed on a rear side of the siding panel at the bottom end, the channel including a vertical leg and a bottom leg, and the channel configured for receipt of the tabs of an adjacent panel; and scrap reducing cutting planes for trimming or cutting the panel to reduce waste. The vertical leg of the upwardly facing channel may include a horizontal slot coinciding with each of the cutting planes.

The polymer siding panel may further include at least two horizontal adjacent sections and at least two splicing members. The splicing members can be translucent and manufactured from a different polymer than the panel, and one of the splicing members can be welded to and join respective side edges of the sections to one another. The other splicing member can be welded to one of the sections at a side edge opposite the side edge joined to the other section, with the other splicing member extending beyond the respective side edge. One side edge of the panel may include a notch in the vertical leg and an upwardly extending lip on the bottom leg adjacent the notch. The bottom leg may have a stepped portion adjacent the notch. The side edge opposite the side edge with the notch has a horizontal slot in the vertical leg. The horizontal slot can be configured to receive the stepped portion of the bottom leg on an adjacent panel with the upwardly extending lip located behind the vertical leg above the horizontal slot of the adjacent panel. The side edges of the adjoining sections may have the same mating configuration as the side edges of the panel.

The polymer siding panel may further include at least one projection on the vertical leg of the upwardly facing channel extending back away from the rear face and a groove in the front face above the elements configured to receive the projection of a vertically adjacent panel. The groove can lock with the projection of the vertically adjacent panel to prevent relative vertical movement between the panels while allowing the panels to slide horizontally relative to one another.

It is yet another feature of the invention to provide an embodiment of a wall covering that includes a plurality of polymer siding panels for mounting on a wall surface wherein a plurality of decorative elements are integrally formed on each panel and disposed in,at least one row, the decorative elements defining a front face of the siding panels; a top edge on each panel disposed above the decorative elements; a plurality of apertures formed in and extending through each of the siding panels below the top edge and above the decorative elements; a bottom end on each panel; a plurality of downwardly depending tabs located on the front faces of the siding panels; and an upwardly facing channel formed on a rear side of each siding panel, the upwardly facing channels including a vertical leg and a bottom leg and configured for receipt of the tabs of a vertically adjacent panel so that each of the vertical legs includes at least one projection extending back from the rear side of the panels and each front face includes a groove therein above said elements. The grooves are configured to receive the projection of a vertically adjacent panel.

Each of the panels may include at least two horizontally adjacent sections and two splicing members. The splicing members may be translucent and manufactured from a transparent or translucent polymer, and one of the splicing members may be welded to adjoining sections of a panel to join respective side edges thereof.

Each panel may include a pair of side edges and a notch adjacent one side edge in the vertical leg of the upwardly facing channel and an upwardly extending lip on the bottom leg adjacent the notch. The bottom leg may have a stepped portion adjacent the notch. The side edge of each panel opposite the side edge with the notch may have a horizontal slot in the vertical leg. The horizontal slot can be configured to receive the stepped portion of the bottom leg on an adjacent panel with the upwardly extending lip on the adjacent panel located behind the vertical leg above the horizontal slot.

Each of the panels may also include scrap reducing cutting planes for trimming or cutting the panels to reduce waste. The vertical legs of the upwardly facing channel on each of the panels may include a horizontal slot coinciding with each of the cutting planes.

The grooves may lock with the projection of a vertically adjacent panel to prevent relative vertical movement between the panels while allowing the locked panels to slide horizontally relative to one another.

BRIEF DESCRIPTION OF THE DRAWINGS

The above-mentioned and other features and objects of this invention and the manner of obtaining them will become more apparent and the invention itself will be better understood by reference to the following description of embodiments of the present invention taken in conjunction with the accompanying drawings, wherein:

FIG. 11 is a rear enlarged perspective view of the bottom section of the two adjoining panels of FIG. 10 with the panels partially connected together;

FIG. 12 is a side view of one panel of the present invention;

Figure 1:
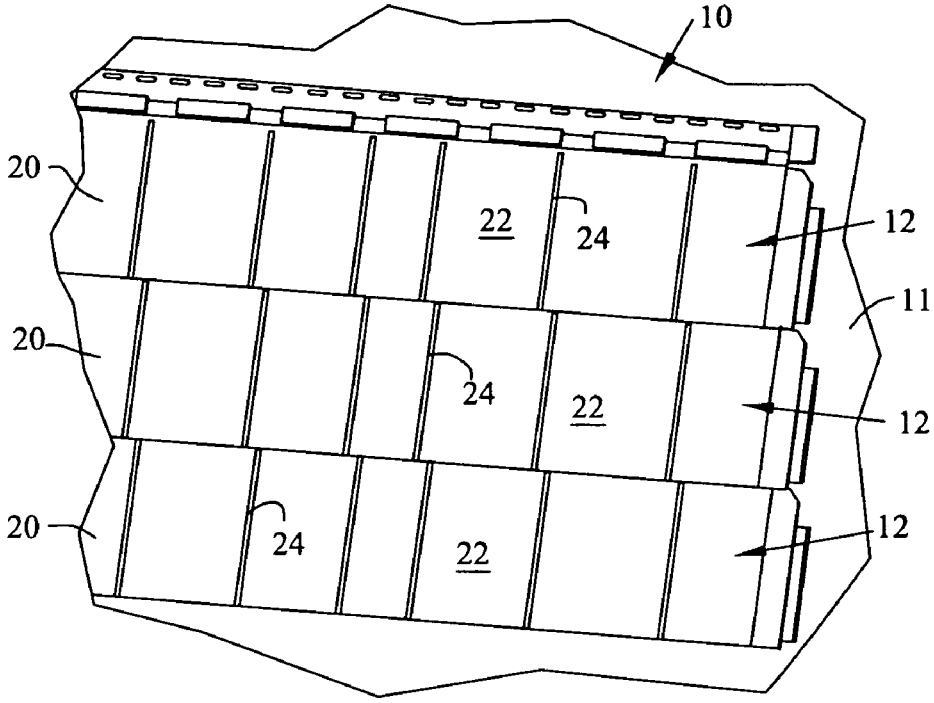
FIG. 1 is a perspective view of a face side of a plurality of the panels of the present invention as would appear mounted on a wall surface.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF EMBODIMENTS OF THE INVENTION

For the purposes of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated devices and described methods and further applications of the principles of the invention, which would normally occur to one skilled in the art to which the invention relates.

Figure 2:
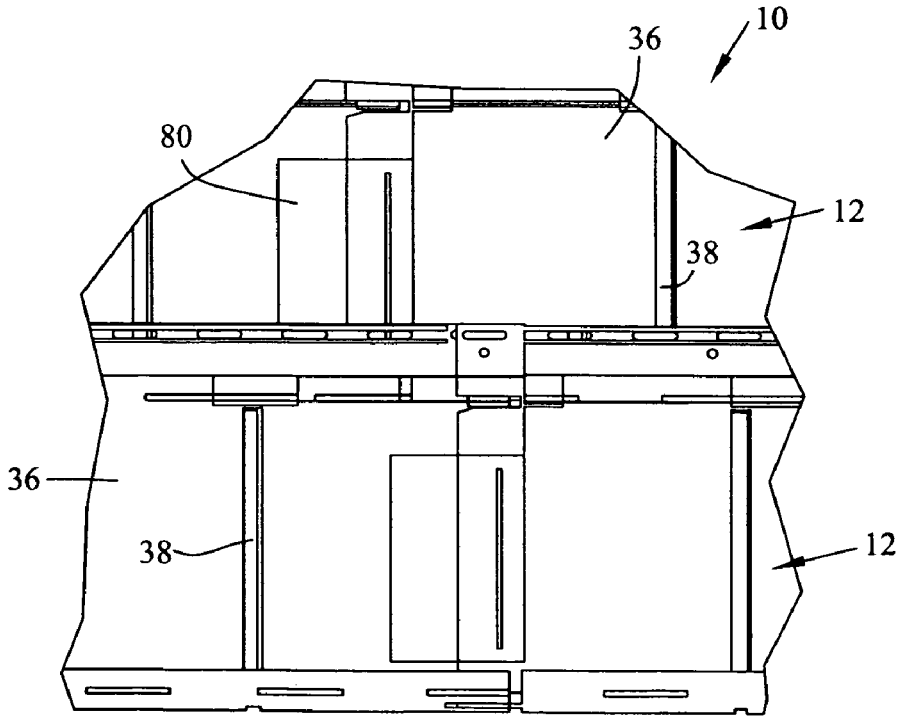
FIG. 2 is a perspective view of the rear side of the plurality of the panels of FIG. 1.
Figure 3:
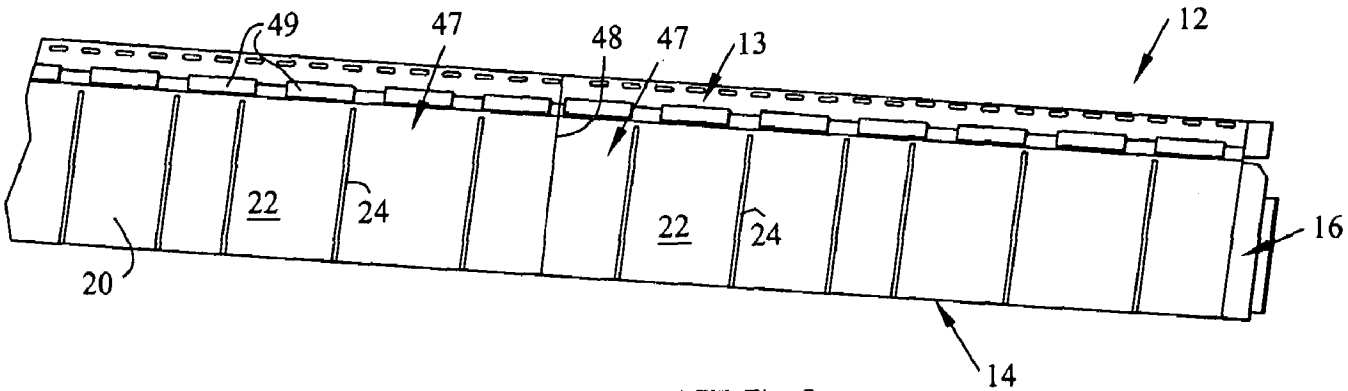
FIG. 3 is a perspective view of the face side of a single row panel of the present invention having a spliced connection and removed from the wall surface.
Figure 6:
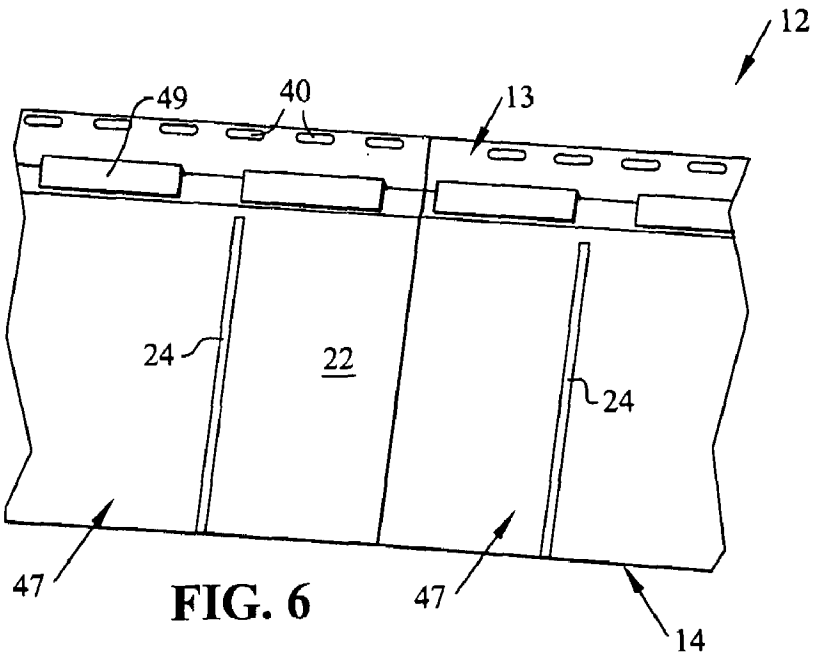
FIG. 6 is a front perspective view showing a connection between two bonded sections of a panel or the connection of two adjacent panels as installed.

The present invention provides exterior siding panels preferably formed by an injection molding process that is designed to facilitate easy installation and dependable performance. Referring to FIGS. 1 and 2, front and rear respective views are shown of a wall covering generally indicated as 10. Wall covering 10 is mounted on a wall surface 11, as shown in FIG. 1. The depiction in FIG. 1 shows three rows of siding panels, generally indicated as 12 fitted vertically together.

Referring to FIGS. 3-6, one of the siding panels 12 is shown apart from the other panels. Each siding panel 12 includes a top portion generally indicated as 13, a bottom portion generally indicated as 14, a right-side portion generally indicated as 16, and a left-side portion generally indicated as 18. In the embodiment shown, panels 10 also include a front face 20 having decorative elements 22, which are separated by gaps 24, to form a single horizontal row of decorative elements 22 having the appearance of cedar shake siding shingles. The decorative elements 22 and panels 12 may have varied widths to provide a more natural appearance.

Figure 4:
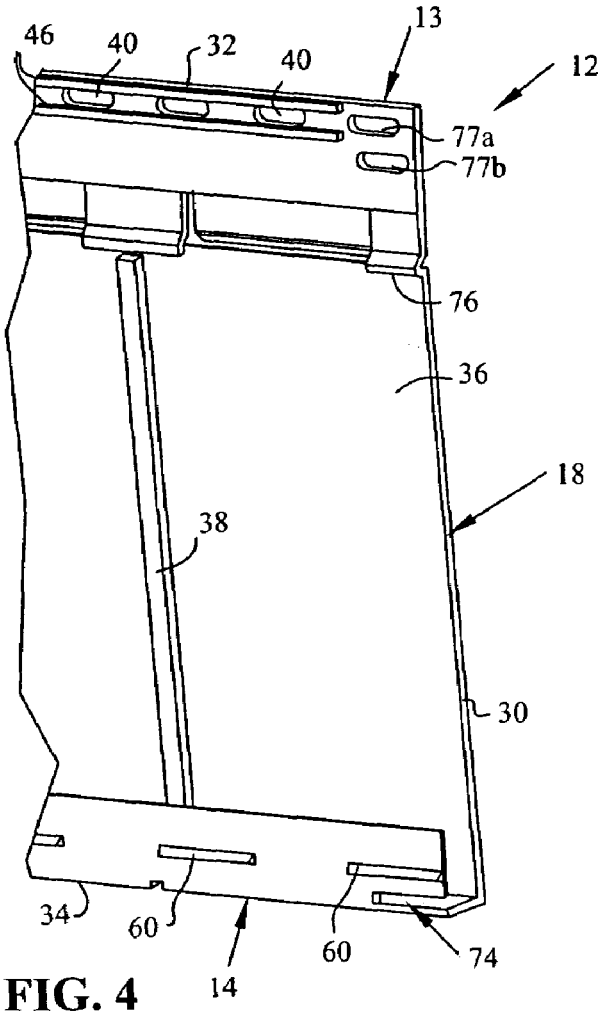
FIG. 4 is a perspective view of a side connection on one end of a panel having a receiving slot therein.
Figure 5:
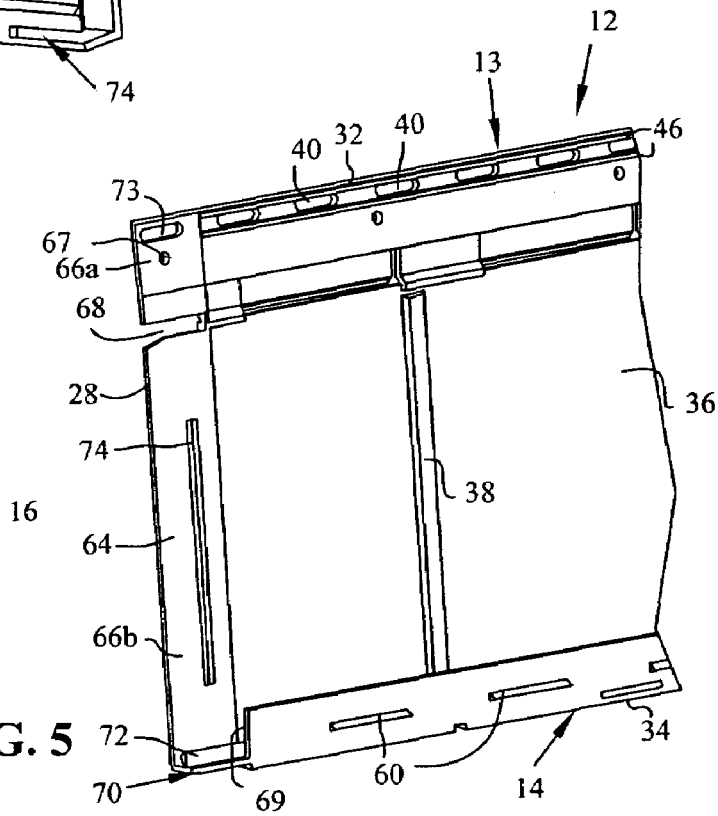
FIG. 5 is a perspective view of the other end of the panel of FIG. 4 showing the mating side connection.

As best shown in FIGS. 4 and 5, right-side portion 16 includes a side edge 28, and left-side portion 18 includes a side edge 30. The top portion 13 of each panel 12 has a top edge 32, while the bottom portion 14 includes a bottom edge 34. Referring now to FIGS. 2, 4, and 5, panels 12 also include a rear side 36 having a plurality of vertically oriented reinforcing ribs 38. Reinforcing ribs 38 coincide with gaps 24 formed between decorative elements 22. Extending through panels 12 are a plurality of nail-mounting apertures 40 disposed in a generally horizontal row adjacent top edge 32. In the embodiment shown, the mounting apertures 40 are elongated to accommodate thermal expansion and contraction of the panels. Panels 12 also include support ridges 46 located on either side of nailing apertures 40 extending in a generally horizontal direction across rear side 36 to side portions 16, 18 for supporting the panels against wall surface 11 when mounted thereto.

Figure 13:
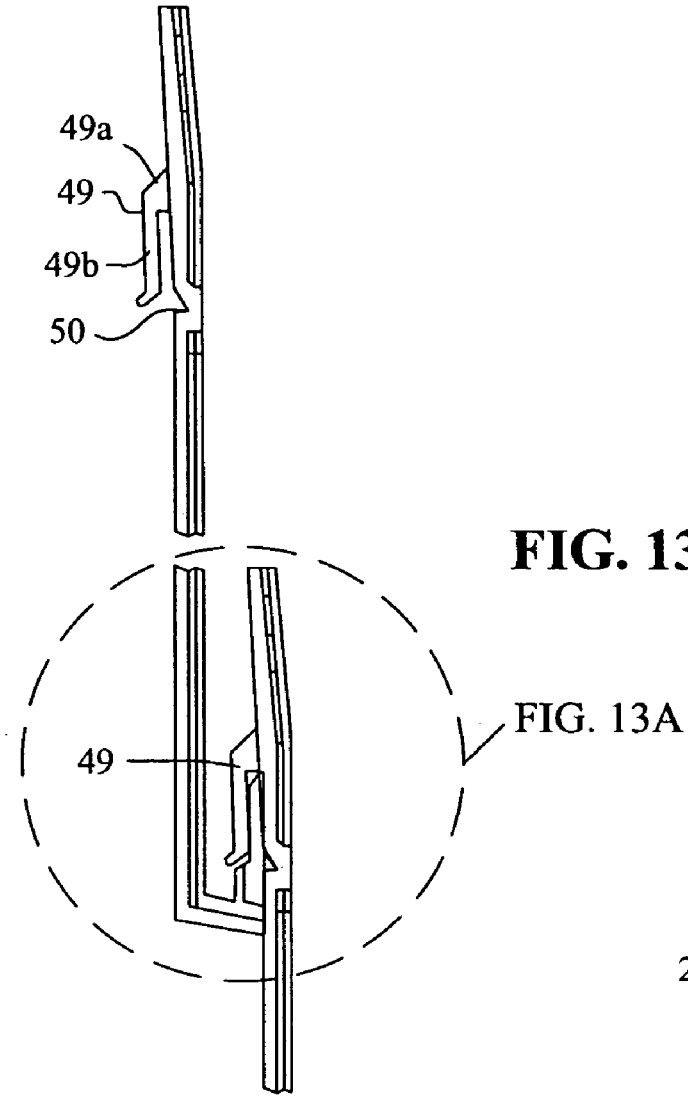
FIG. 13 is a side view of two vertically adjacent panels of the present invention connected together.
Figure 13A:
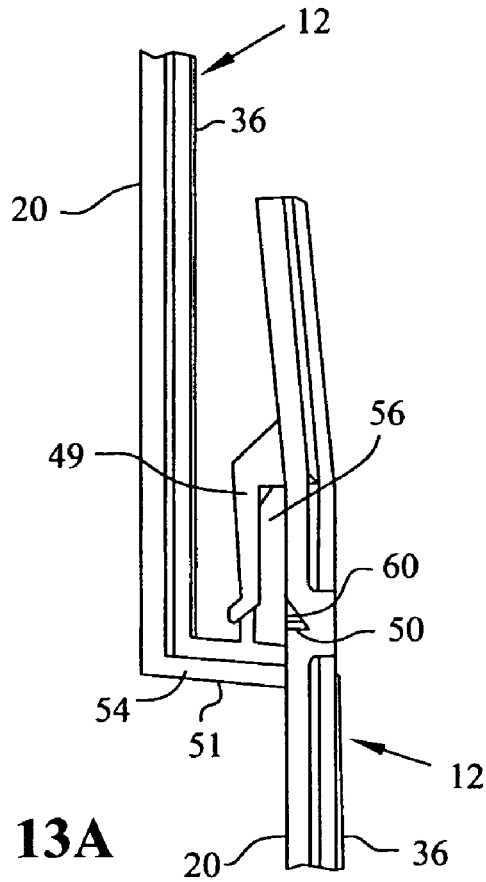
FIG. 13A is an enlargement of the area indicated in FIG. 13 of two vertically adjacent panels connected together.

In the embodiment shown, panels 12 each include two or more sections generally indicated as 47 that are preassembled and connected to one another at a joint 48 prior to mounting panel 12 to wall surface 11. Panels 12 include a number of features for interconnecting sections 47 together and for also interconnecting horizontally and vertically adjacent panels 12 to one another when installing them on the wall surface 11. For connecting one panel above another, each panel includes a plurality of downwardly depending tabs 49 extending from front face 20. As best shown in FIGS. 12, 13, and 13A, each downwardly depending tab 49 has a base 49*a* in a vertical leg 49*b*. Tabs 49 are located in an intermittent horizontal row below nailing apertures 40 and above decorative elements 22. Also located on front face 20 of siding panels 12 is a horizontally extending groove 50 that is located above decorative elements 22 behind or near the bottom of vertical legs 49*b* of downwardly depending tabs 49 for reasons discussed below.

Panels 12 also include an upwardly facing channel 51 formed along the bottom edge 34 on rear side 36. In the embodiment shown, upwardly facing channels 51 each include a rearwardly projecting leg 54, and an upwardly extending leg 56, having an upper beveled end 58. Also located on upwardly extending leg 56 are intermittently spaced projections 60 extending away from rear side 36. Projections 60 run in a horizontal direction and are configured to be received by the horizontal groove 50 of a vertically adjacent panel 12. Although projections 60 are shown in an intermittent arrangement, it should be appreciated that continuous projections could be used that extend across the length of the panel.

Referring again to FIGS. 4 and 5, to connect side-by-side panels 12 and panel sections 47 to one another, the right-side portion 16 includes a tongue 64, which includes an upper portion 66*a* and a lower portion 66*b*. In the embodiment shown, upper portion 66*a* includes a hole 67 for receipt of a nail (not shown) for centering the panels. A slot 68 separates upper portion 66*a* and lower portion 66*b*. At the lower end of right-side portion 16, a notch generally indicated as 69 is located in upwardly extending leg 56 of upwardly facing channel 51. Furthermore, rearward projecting leg 54 of upwardly facing channel 51 has a stepped portion generally indicated as 70 at the right-side portion 16. Also located on rearwardly projecting leg 54 in the region of stepped portion 70 is an upwardly extending lip 71, which is slightly offset from upwardly extending leg 56 and located closer to rear side 36 of panel 12. Located on the rear side of lower portion 66*b* of tongue 66 is a vertically extending opening 72. Opening 72 may also be a groove into tongue 64 and may be intermittent or longer or shorter than shown. A nailing aperture 73 may be located on the upper portion 66*a* of tongue 64. Channel 51 may also include a plurality of weep holes (not shown) located at the bottom of upwardly extending leg 56 for allowing any moisture trapped in channel 51 to drain therefrom.

At the left-side portion 18 of panels 12 and panel sections 47, a horizontal slot generally indicated as 74 is provided in upwardly extending leg 56 of upwardly facing channel 51, as best shown in FIG. 4. For reasons discussed below, horizontal slot 74 is configured to receive stepped portion 70 of an adjacent panel 12 or panel section 47. Left-side portion 18 also includes a protrusion 76 that is aligned with and receivable by slot 68 of an adjacent panel 12 or panel section 47. Left side 18 may also include a nailing aperture 77*a* and a slot opening 77*b* that aligns with hole 67 for receipt of the centering nail (not shown). It should also be appreciated that when panel sections 47 are joined together, aperture 73 and 77*a* will be aligned with one another and overlap.

Figure 7:
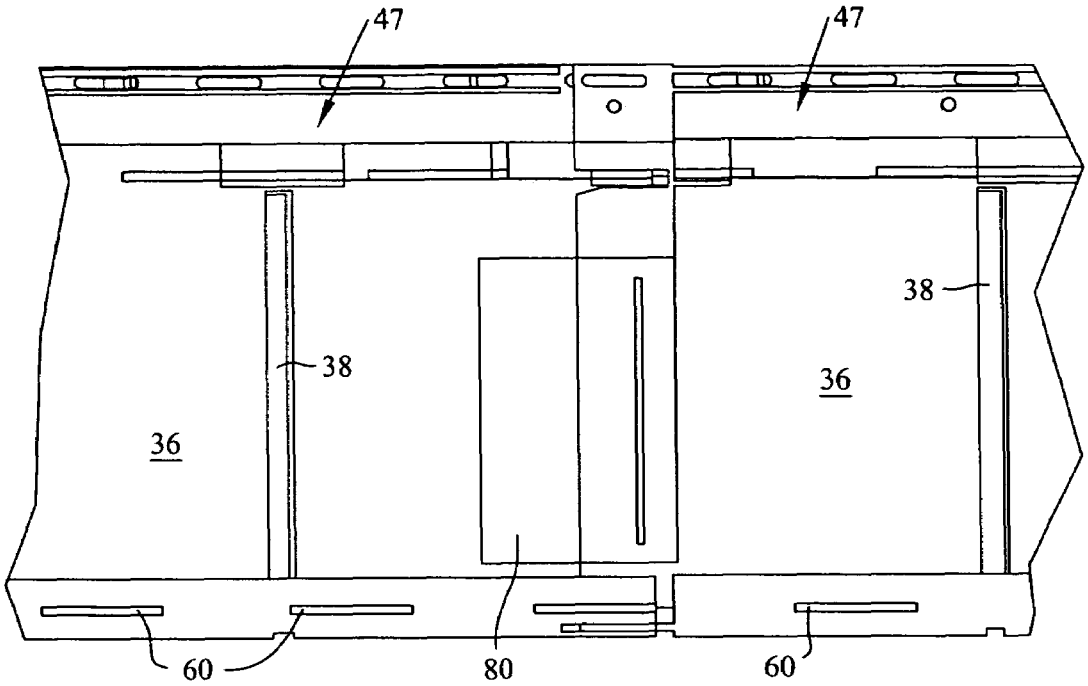
FIG. 7 is a rear perspective view showing the joint of FIG. 6 including a splicing member.
Figure 8:
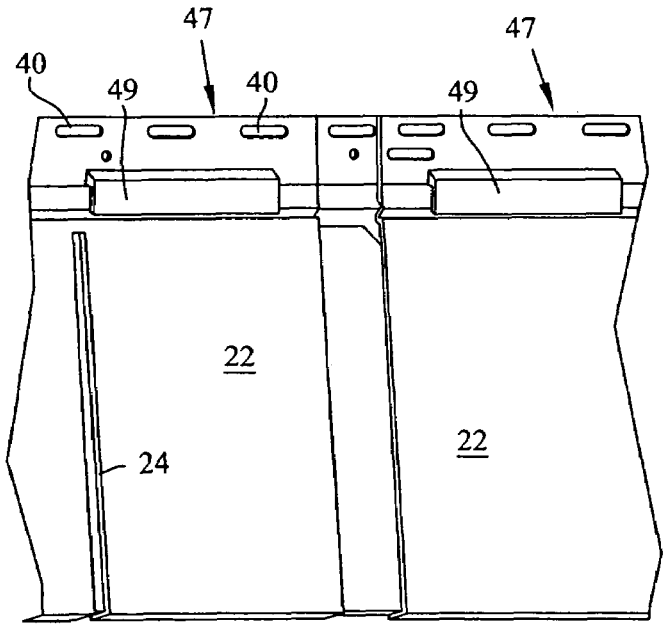
FIG. 8 is a front perspective view of two horizontally adjacent panels being joined together.
Figure 9:
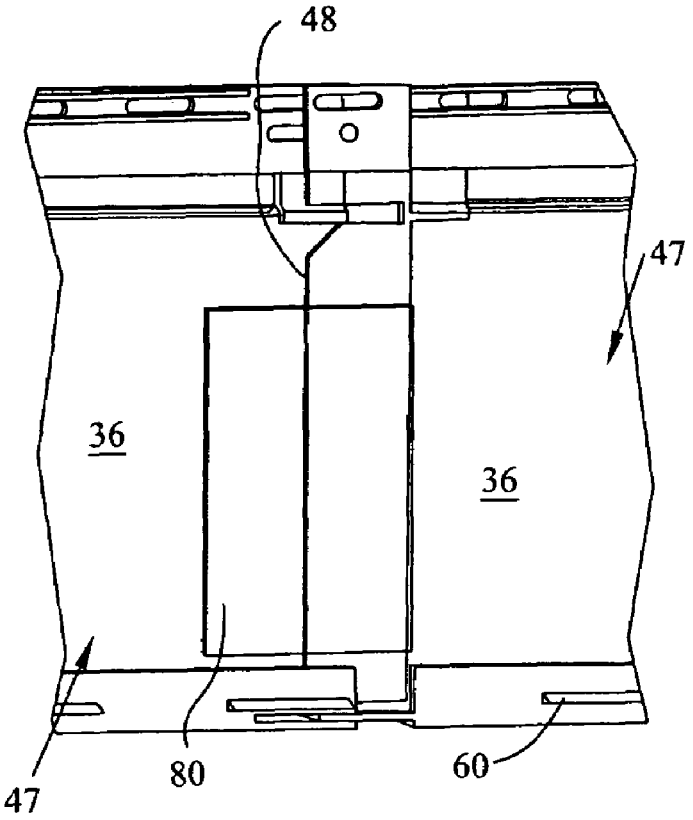
FIG. 9 is a rear perspective view of two horizontally adjacent panels being joined together.
Figure 10:
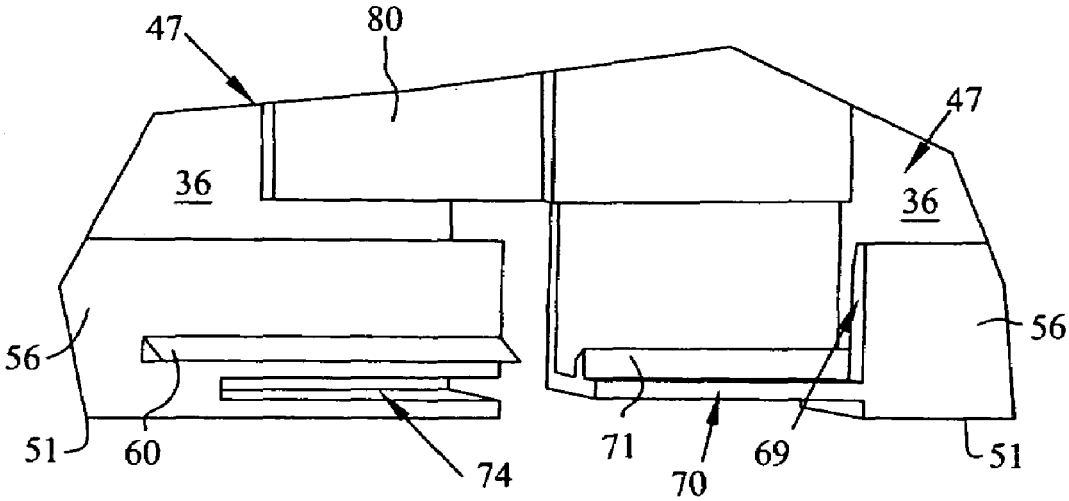
FIG. 10 is an enlarged perspective view of the bottom connection of two adjoining panels to be connected.

Referring now to FIGS. 2 and 7, splicing members 80 are provided for joining two horizontally adjacent panels 12 or two panel sections 47. In the embodiment shown, splicing members 80 are rectangular panels and may be made from a transparent or translucent polymer such as polypropylene for reasons discussed below. The splicing member may also be opaque and match the color of the panels if a suitable weld can be produced. Splicing member 80 may also include a lip or ridge configured to be received in opening 72 for providing a more secure joint.

Figure 14:
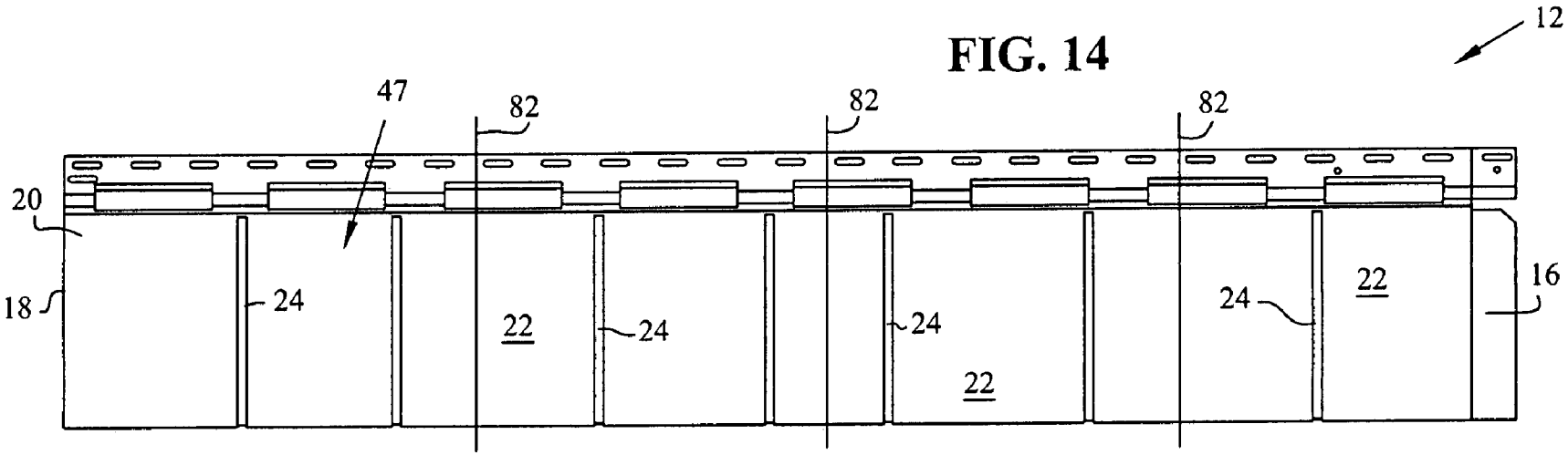
FIG. 14 is a front plan view of a panel of the present invention showing scrap reducing cutting planes.
Figure 15:
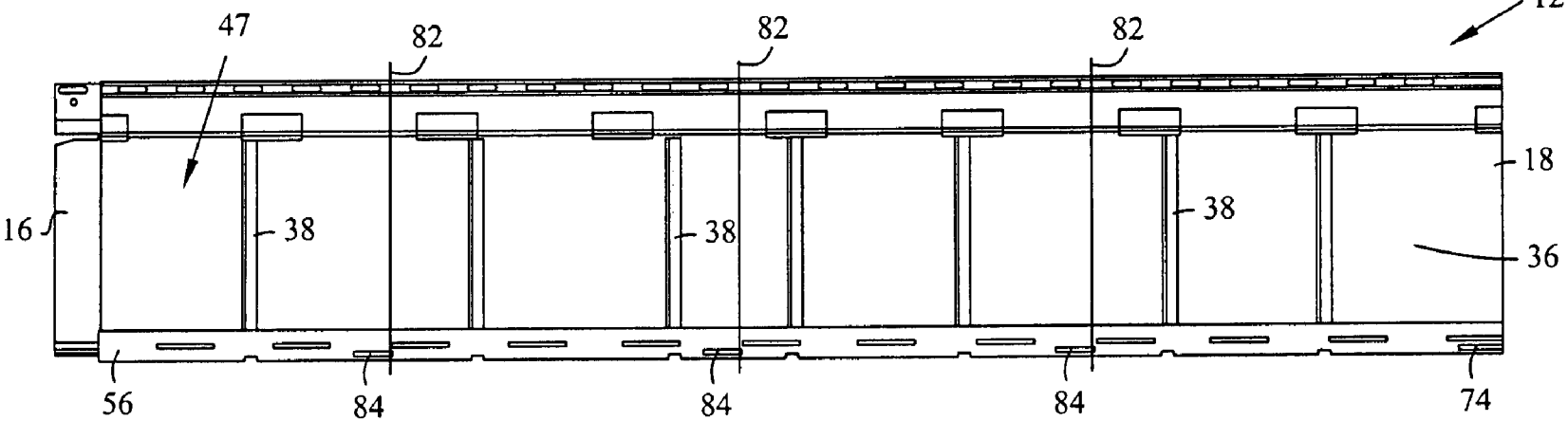
FIG. 15 is a rear plan view of a panel of FIG. 14 showing the cutting planes.
Figure 16:
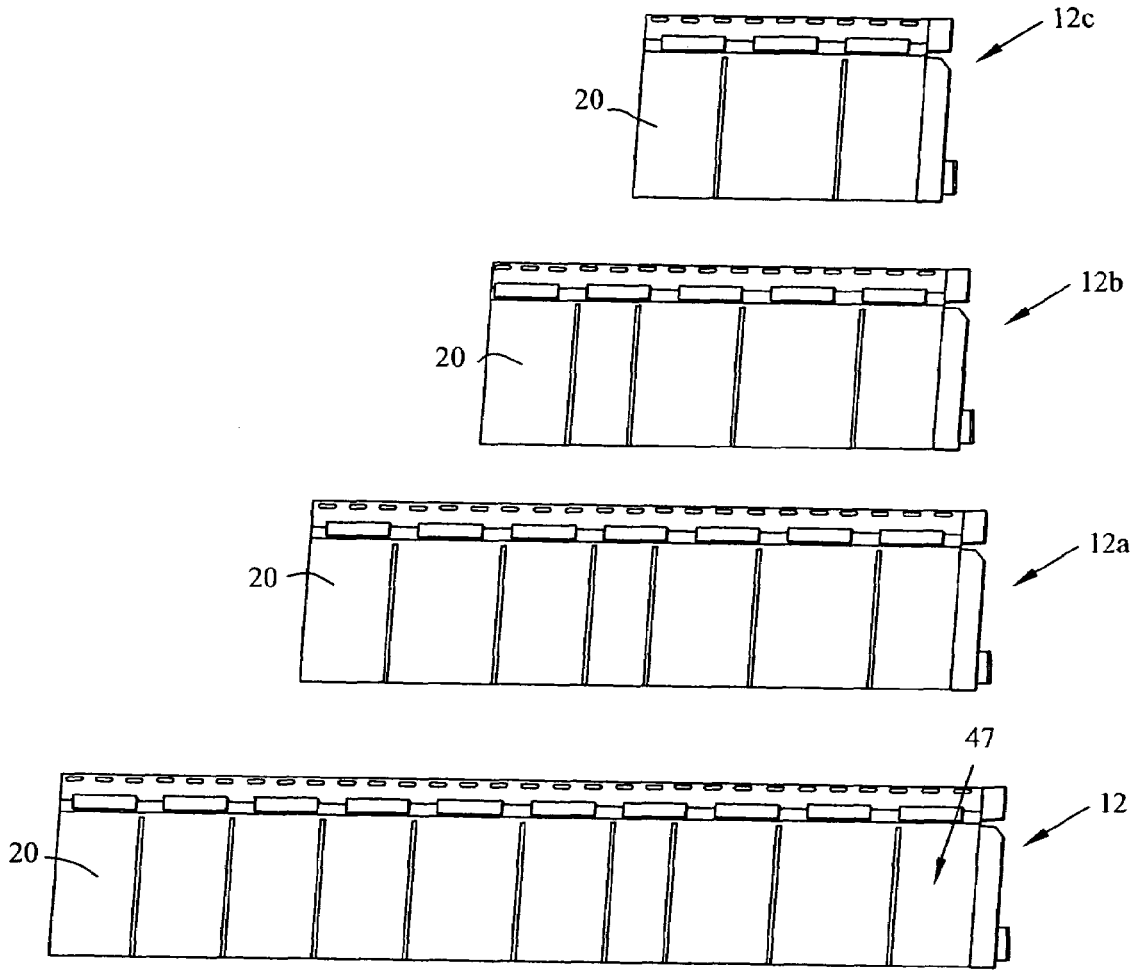
FIG. 16 is a front perspective view of panels that have been cut along the different cutting planes of FIG. 14.

Now referring to FIGS. 14-16, panels 12 may also include marked cutting planes 82 that may be used for reducing scrap when trimming or cutting panels 12. As shown in FIG. 15, aligned with the cutting planes, horizontal slots 84 may also be included in upwardly extending leg 56, which will resemble horizontal slot 74 when panels 12 are cut along the respective cutting plane 82. Cutting the panels along one of the respective cutting planes produces the reduced length panels generally indicated as 12*a*-12*c* in FIG. 16. It should be appreciated that horizontal slots 74 and 84 may also function as weep holes. Furthermore, in the embodiment shown in FIGS. 14-16, three cutting planes are shown on one of the panel sections 47; however, it should be realized that the number and placement of the cutting planes may be varied as desired.

As discussed above, one method of providing a desirable appearance on panel 12, which may be made from a polypropylene, vinyl, or other polymer material, is the injection molding process; however, the length of the panels formed by this method may be limited due to the cost of providing dies and injection molding machines of sufficient size to make panels that are 8 feet or longer. Accordingly, in one embodiment of the invention, panel sections 47 are provided, which may be spliced together to provide longer panels 12. To splice panel sections 47 together, the ends of each panel section are provided with the end connections shown in FIGS. 4 and 5 on right-side portion 16 and left-side portion 18. As shown in FIGS. 7 and 9-11, the panel sections are connected so that stepped portion 70 on one section 47 is received in the horizontal slot 74 of the horizontally adjacent section 47 with upwardly extending lip 71 located behind the upwardly extending leg 56 of the left-side portion 18 on the adjacent section 47. Furthermore, protrusion 76 of the adjacent section 47 is received in slot 68 of the one section 47 between upper portion 66*a* and lower portion 66*b* of tongue 64. In addition, to secure the panel sections together, a splicing member 80 may be used at each connection. The splicing member may be adhered to the rear sides 36 of panel sections 47 adjacent respective right-side and left-side portions 16, 18 by use of an adhesive, by welding or using other known bonding means. Use of laser welding, as is known, may be preferable for minimizing heat input and distortion of the welding process. Furthermore, if splicing members 80 are transparent or translucent, this facilitates passing the laser through the splicing member to the opaque panel surface, where it will heat the members up and form a lap weld joint between the panel sections and splicing member. It should be appreciated that the material used to make splicing members 80 may be different than the panels, but should have a coefficient of thermal expansion that is compatible with the material used to make panels 12 so that the panels or joints will not buckle or tear the welds during expansion and contraction of the panels due to changes in temperature.

To assemble panels 12 on a wall, a first horizontal row is provided. Horizontally adjacent panels 12 are connected to one another the same as panel sections 47 except that splicing member 80 is only welded or otherwise attached to only one of either right- or left-side portions 16 or 18; the splicing member merely overlaps the other adjoining side to provide support at the connection. It should be appreciated that ridges 72 may be used on either right- or left-side portion 16 or 18 to provide a separation of the splicing members 80 from the rear side 36 for ease in fitting the panels together. The panels are attached to wall surface 11 using nails or other fasteners (not shown) as is well known, inserted through mounting apertures 40, 73 and 77*a*, 77*b*.

To install a second and subsequent row of panels 12, the upwardly extending leg 56 of upwardly facing channel 51 on the upper panel 12 is inserted into the space behind leg 49*b* of downwardly depending tabs 49 on the lower panels 12. When inserted thusly, the projections 60 on the upwardly extending leg 56 of the upper panel will be interlocked with horizontal groove 50 of the lower panel. This will hold the upper panel to the lower panel until it is nailed to wall surface 11; however, the projection can slide along the groove to allow horizontal movement of the upper panel relative to the lower panel so that it can be slid into place.

For staggering the decorative elements 22 on the panels and when a full length panel is not required, the panels may be cut along a desired cutting plane 82. When cut along the cutting planes, a horizontal slot 84 will now be located along the left-side portion 18 of the cut panel, which may be installed to any right-side portion 16, as horizontal slots 84 can receive the stepped portion 70 of the adjacent panel the same as horizontal slot 74.

While the invention has been taught with specific reference to these embodiments, one skilled in the art will recognize that changes can be made in form and detail without departing from the spirit and scope of the invention. The described embodiments are to be considered, therefore, in all respects only as illustrative and not restrictive. As such, the scope of the invention is indicated by the following claims rather than by the description.

What is claimed is:

1. A polymer siding panel for mounting on a wall surface, comprising:

at least two horizontal adjacent sections;

a plurality of decorative elements integrally formed with said panel and disposed in at least one row, said decorative elements defining a front face of said siding panel;

a top edge disposed above said decorative elements;

a plurality of apertures formed in and extending through said siding panel disposed below said top edge and above said decorative elements;

a plurality of downwardly depending tabs located on said front face of said siding panel;

an upwardly facing channel formed on a rear side of said siding panel opposite said front face; and at least two splicing members, said splicing members being transparent or translucent and manufactured from a polymer that is of a different material than said sections, and one of said splicing members welded to and joining said sections to one another, and wherein each of said sections includes side edges and one side edge of each section has a tongue, and said tongue overlapping the side edge of an adjacent section, and when said splicing members are welded to and adjoin said sections, a layered joint is formed that includes a first layer of the side edge of one section, not having a tongue, the side edge of the adjoining section with a tongue, and said splicing member, said tongue being sandwiched between the other side edge and the splicing member in an overlapping fashion; and said other splicing member is welded to one of said sections at a side edge opposite said side edge adjoining said other section, said other splicing member extending beyond said respective side edge; and said upwardly facing channel has a vertical leg and a bottom leg, and one of said side edges includes a notch in said vertical leg forming a notched area; and an upwardly extending lip on said bottom leg in said notched area, said bottom leg having a portion in said notched area that is stepped to be higher than the rest of said bottom leg, and said lip is located on said stepped portion and extending above a horizontal plane defined by said stepped portion.

2. The polymer siding panel as set forth in claim 1, wherein said upwardly extending lip is positioned intermediate said rear face and an outer end of said bottom leg, and said vertical leg is located farther from said rear face than said upwardly extending lip.

3. The polymer siding panel as set forth in claim 2, wherein said side edge opposite said side edge having said notch includes a horizontal slot in said vertical leg.

4. The polymer siding panel as set forth in claim 3, wherein said slot is configured to receive said stepped portion of said bottom leg of an adjacent panel with said upwardly extending lip on the adjacent panel fitting behind said vertical leg above said horizontal slot.

5. The polymer siding panel as set forth in claim 1, including scrap reducing cutting planes for trimming or cutting the length of the panel to reduce waste.

6. The polymer siding panel as set forth in claim 5, wherein said vertical leg of said upwardly facing channel includes a horizontal slot coinciding with each of said cutting planes.

7. The polymer siding panel as set forth in claim 1, wherein said upwardly facing channel includes a vertical leg having a projection extending back therefrom away from said rear face.

8. The polymer siding panel as set forth in claim 7, wherein said front face of said panel includes a groove above said decorative elements configured to receive said projection of a vertically adjacent panel.

9. The polymer siding panel as set forth in claim 8, wherein said groove locks with the projection of the vertically adjacent panel to prevent relative vertical movement between the panels while allowing the panels to slide horizontally relative to one another.

10. A polymer siding panel for mounting on a wall surface comprising:

a plurality of decorative elements integrally formed with said panel and disposed in at least one row, said decorative elements defining a front face of said siding panel;

a top edge disposed above said decorative elements;

a plurality of apertures formed in and extending through said siding panel disposed below said top edge and above said decorative elements;

a bottom end;

a plurality of downwardly depending tabs located on said front face of said siding panel;

an upwardly facing channel formed on a rear side of said siding panel along said bottom end, said channel having a vertical leg and a bottom leg extending from a rear face of said siding panel and said channel configured for receipt of said tabs of a vertically adjacent panel; and a pair of side edges, one of said edges including a notch in said vertical leg forming a notched area and an upwardly extending lip on said bottom leg in said notched area, said bottom leg having a stepped portion in said notched area that is vertically offset from the remainder of said bottom leg, and said lip located on said stepped portion and extending above a horizontal plane defined by said stepped portion.

11. The polymer siding panel as set forth in claim 10, wherein said upwardly extending lip is located intermediate said rear face and an outer end of said bottom leg, and said vertical leg is located farther from said rear face than said upwardly extending lip, and said lip extending predominently in a direction substantially parallel to said rear face of said siding panel.

12. The polymer siding panel as set forth in claim 11, wherein said side edge opposite said side edge with said notch includes a horizontal slot in said vertical leg, and a portion of said vertical leg extends above said slot to said side edge of said siding panel so that said slot is defined as a narrow channel between said vertical leg and said bottom leg, the slot being open only to the adjacent side edge of the corresponding panel.

13. The polymer siding panel as set forth in claim 12, wherein said horizontal slot is configured to receive said stepped portion of said bottom leg on an adjacent panel with said upwardly extending lip located directly behind said vertical leg above said horizontal slot.

14. The polymer siding panel as set forth in claim 10, including at least two horizontal adjacent sections and at least two splicing members, said splicing members manufactured from a different polymer, and one of said splicing members welded and joining said sections to one another along side edges thereof.

15. The polymer siding panel as set forth in claim 14, wherein said other splicing member is welded to one of said sections at a side edge opposite said side edge joined to said other section, said other splicing member extending beyond said respective side edge.

16. The polymer siding panel as set forth in claim 10, including scrap reducing cutting planes to trim or cut the panel to reduce waste, said vertical leg of said upwardly facing channel including a horizontal slot coinciding with each of said cutting planes, each of said horizontal slots being defined as a narrow channel extending through said vertical leg and being substantially surrounded by said vertical leg.

17. The polymer siding panel as set forth in claim 10, further including a projection extending back from said vertical leg of said upwardly facing channel away from said rear face and a groove above said elements configured to receive the projection of a vertically adjacent panel.

18. The polymer siding panel as set forth in claim 17, wherein said groove locks with said projection of the vertically adjacent panel to prevent relative vertical movement between the panels while allowing the panels to slide horizontally relative to one another.

19. A polymer siding panel for mounting on a wall surface comprising:

a plurality of decorative elements integrally formed with said panel and disposed in at least one row, said decorative elements defining a front face of said siding panel;

a top edge disposed above said decorative elements;

a plurality of apertures formed in and extending through said siding panel disposed below said top edge and above said decorative elements;

a bottom end;

a plurality of downwardly depending tabs located on said front face of said siding panel;

an upwardly facing channel formed on a rear side of said siding panel at said bottom end, said channel including a vertical leg and a bottom leg, and said channel configured for receipt of said tabs of an adjacent panel; and scrap reducing cutting planes for trimming or cutting the panel to reduce waste, and said vertical leg of said upwardly facing channel including a horizontal slot coinciding with each of said cutting planes, each of said horizontal slots being defined as a narrow channel extending through said vertical leg and being substantially surrounded by said vertical leg.

20. The polymer siding panel as set forth in claim 19, including at least two horizontal adjacent sections and at least two splicing members, said splicing members being translucent and manufactured from a different polymer than said panel, and one of said splicing members welded to and joining respective side edges of said sections to one another.

21. The polymer siding panel as set forth in claim 20, wherein said other splicing member is welded to one of said sections at a side edge opposite said side edge joined to said other section, said other splicing member extending beyond the respective side edge.

22. The polymer siding panel as set forth in claim 21, wherein one side edge of said panel includes a notch in said vertical leg and an upwardly extending lip on said bottom leg adjacent said notch, said bottom leg having a stepped portion adjacent said notch.

23. The polymer siding panel as set forth in claim 22, wherein said side edge opposite said side edge with said notch has a horizontal slot in said vertical leg.

24. The polymer siding panel as set forth in claim 23, wherein said horizontal slot is configured to receive said stepped portion of said bottom leg on an adjacent panel with said upwardly extending lip located behind said vertical leg above said horizontal slot of said adjacent panel.

25. The polymer siding panel as set forth in claim 24, wherein said side edges of said adjoining sections have the same mating configuration as the side edges of the panel.

26. The polymer siding panel as set forth in claim 19, including at least one projection on said vertical leg of said upwardly facing channel extending back away from said rear face and a groove in said front face above said elements configured to receive the projection of a vertically adjacent panel.

27. The polymer siding panel as set forth in claim 26, wherein said groove locks with the projection of the vertically adjacent panel to prevent relative vertical movement between the panels while allowing the panels to slide horizontally relative to one another.

28. A wall covering including a plurality of polymer siding panels for mounting on a wall surface comprising:

a plurality of decorative elements integrally formed on each panel and disposed in at least one row, said decorative elements defining a front face of said siding panels;

a top edge on each panel disposed above said decorative elements;

a plurality of apertures formed in and extending through each of said siding panels below said top edge and above said decorative elements;

a bottom end on each panel;

a plurality of downwardly depending tabs located on said front faces of said siding panels; and an upwardly facing channel formed on a rear side of each of said siding panels, said upwardly facing channel including a vertical leg and a bottom leg and configured for receipt of said tabs of a vertically adjacent panel, each of said vertical legs including at least one projection extending back from said rear side of said panels and each front face including a groove therein above said elements extending perpendicularly into said front face, said grooves configured to receive said projection of a vertically adjacent panel.

29. The wall covering as set forth in claim 28, wherein each of said panels includes at least two horizontally adjacent sections and two splicing members, said splicing members being transparent or translucent and manufactured from a polymer, and one of said splicing members being welded to adjoining sections of a panel to join respective side edges thereof.

30. The wall covering as set forth in claim 28, wherein each panel includes a pair of side edges and a notch adjacent one side edge in said vertical leg of said upwardly facing channel forming a notched area and an upwardly extending lip on said bottom leg in said notched area, said bottom leg having a stepped portion in said notched area, and said lip is located on said stepped portion.

31. The wall covering as set forth in claim 30, wherein said side edge of each panel opposite said side edge with said notch has a horizontal slot in said vertical leg, said horizontal slot configured to receive said stepped portion of said bottom leg on an adjacent panel with said upwardly extending lip on the adjacent panel located behind said vertical leg above said horizontal slot.

32. The wall covering as set forth in claim 28, wherein each of said panels includes scrap reducing cutting planes for trimming or cutting the panels to reduce waste, said vertical legs of said upwardly facing channel on each of said panels including a horizontal slot coinciding with each of said cutting planes.

33. The wall covering as set forth in claim 28, wherein said grooves lock with the projection of a vertically adjacent panel to prevent relative vertical movement between the panels while allowing the locked panels to slide horizontally relative to one another, and said projections are intermittent and do not extend continuously across the panels.

34. A polymer siding panel as set forth in claim 1, wherein both of said splicing members on each side of the sections extend beyond respective side edges of the sections and beyond the decorative elements.

* * * * *